United States Patent [19]

Edlund

[11] 4,359,170

[45] Nov. 16, 1982

[54] CAN CLOSURE PROVIDED WITH OPENING TAB

[76] Inventor: Harry Edlund, Terserusvägen 26, S-161 52 Bromma, Sweden

[21] Appl. No.: 276,385

[22] PCT Filed: Oct. 24, 1980

[86] PCT No.: PCT/SE80/00259

§ 371 Date: Jun. 16, 1981

§ 102(e) Date: Jun. 16, 1981

[87] PCT Pub. No.: WO81/01128

PCT Pub. Date: Apr. 30, 1981

[30] Foreign Application Priority Data

Oct. 26, 1979 [SE] Sweden ..... 7908904

[51] Int. Cl.[3] ..... B65D 17/32; B65D 41/32

[52] U.S. Cl. ..... 220/268

[58] Field of Search ..... 220/268–273, 220/90.4; 229/7 R; 222/541

[56] References Cited

U.S. PATENT DOCUMENTS

| | | | |
|---|---|---|---|
| 3,927,794 | 12/1975 | Erdman | 220/268 |
| 4,210,256 | 7/1980 | Amberg et al. | 229/7 R X |
| 4,311,249 | 1/1982 | Joyce | 220/268 |

*Primary Examiner*—George T. Hall

*Attorney, Agent, or Firm*—Pollock, Vande Sande & Priddy

[57] ABSTRACT

The invention relates to a can closure of plastic having a fastening flange around its periphery. A groove (5) is positioned inside the flange and inside the groove is a central portion (7) bowed inwardly in relation to the can. The groove (5) is interrupted by an up-bent elevation (9) extending substantially flush with the upper edge of the flange up to the central portion. An opening tab (11) extends along the elevation from adjacent the flange to near the center of said central portion (7).

6 Claims, 2 Drawing Figures

CAN CLOSURE PROVIDED WITH OPENING TAB

Figure 1:
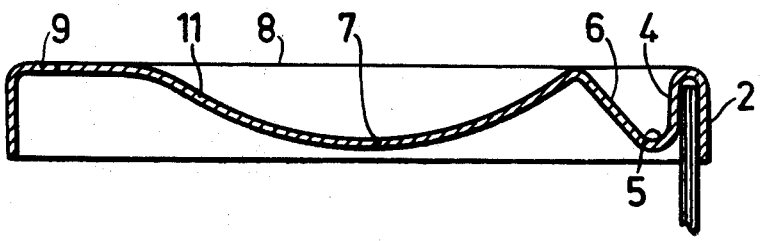

The present invention relates to a can closure provided with an opening tab and consisting of a plastic material or the like.

Can closures provided with opening tab are previously known, for instance plate cans for various drinks. These can closures have, however, the disadvantage, that it is relatively unpleasant for the lips when drinking directly out of the opening obtained after the tab has been torn off, among other things due to the flange edge extending up over the plane of the closure. There is also a risk to spill the drink at the side of the mouth. Moreover, there is the disadvantage, that after only tearing up the tab, i.e. not tearing off, the tab can not again close the opening.

It is among other things an object of this invention to eliminate the above mentioned disadvantages by means of a can closure which is simple to manufacture. The closure is formed particularly for use in connection with sheet can body material, for instance board material suitably treated for the content of the can.

As previously known the can closure according to the invention includes a peripheral fastening flange formed with a wall faced inwardly towards the center of the closure and forming outer side wall for a groove, the inner side wall of which transforms into a central portion, which relative to a plane through the top edge of the flange at least partly has a convex configuration. In order to achieve the above mentioned objects and also give other advantages, the present invention is characterized in that the groove along a smaller portion of the flange is interrupted by an up-bent elevation which is substantially flush with the top edge of the flange and extends between this edge and the central portion, and that an opening tab extends from or near the top edge of the flange along the elevation up to at least the transition to the central portion.

Owing to the plane up-bent elevation provided with the opening tab it is more pleasant to drink directly from the can than from previously known cans. Moreover, all content can be emptied from the can as distinguished from for instance the above mentioned plate cans, which only with certain difficulties can be completely emptied. As also distinguished from said known plate cans, an opening tab in a can closure according to the invention renders it possible not to be torn off at its inner end and the opening can easily be resealed if a portion of the can content is not consumed.

Said advantages give in combination with the groove and the central portion in a can closure according to the invention further advantages. The central portion is expandable outwardly upon an increased pressure within the can, wherein the groove acts as a bellows or membrane and takes up forces deriving from deformation upon said expansion. This renders it possible to use for instance a thin cylinder of board or the like as the can mantle, which is a substantially cheaper material than for instance plate, and such cylinders can easily be manufactured on site where the filling of the cans takes place. Up to now can manufacture has taken place in factories adapted thereto and the cans have been transported to the user. Moreover, pressure for instance occurred during the pasteurization of tin cans is taken up by the central portion, which herewith is bowed outwardly, whereupon the central portion, after that the pressure in the can upon preceding cooling has released and vacuum has occurred in the can, is automatically by spring action returned to its original shape. In for instance a can containing aerated liquids an internal pressure can be obtained which elastically expands the central portion, wherein the groove resiliently takes up the forces deriving from this deformation.

Figure 2:
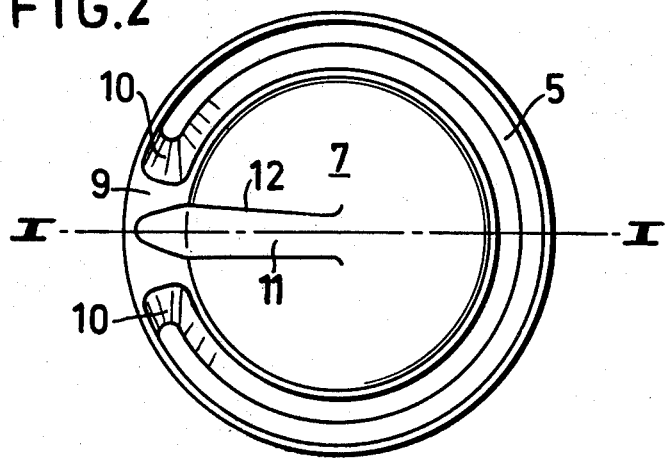

A preferred embodiment of a can closure according to the invention is described in the following with reference to the accompanying drawing, in which:

FIG. 1 is a section along the line I—I in FIG. 2 and also shows a portion of the mantle of the can for illustrating the fastening of the can closure to the mantle, and FIG. 2 shows a plane view of the can closure in smaller scale.

The can closure is made in one piece and from a suitable plastic material. In the embodiment shown the can closure is formed with a surrounding U-shaped flange having an outer shank 2 and an inner shank 4, which surrounds the outer edge portion of the mantle 3 of the can. The shank 4 forms the outer side wall of a groove 5 extending along the flange. The inner wall 6 of the groove emerges into a central portion 7, which in relation to a plane 8 through the upper edge of the flange is convexly shaped. The groove 5 is along a smaller part of the surrounding flange interrupted by an up-bent elevation 9, which extends substantially flat between the upper edge of the flange and the central portion. The limiting sides of the groove 5 to the elevation are designated with the reference numerals 10. An opening tab 11 extends from near the flange along the elevation up to, as shown, the center of the central portion. The tab 11 is bordered by a thin slit or a notch line 12 and this slit or notch line at the inner end of the tab 11 is made such that the inner end of the tab is widened. The length of the elevation 9 in peripheral direction as well as the width of the tab are adapted to the actual content of the can.

Although not shown, the outer end portion of the tab 11 is fastened to means for opening the tab. Said means preferably consists of a tape ribbon, which extends outwardly from the tab over the flange so that the tape ribbon can be easily grasped.

Although not shown, the bottom of the can has preferably the same configuration as the closure in respect to the flange, central portion and groove, but the groove of the bottom extends along the whole flange and no tab is provided.

The invention is not limited to the embodiment described above and shown on the drawing, but can be varied in different ways within the scope of the following claims. Thus, the tab can extend in over the central portion a shorter or longer distance than shown. Moreover, the groove does not necessarily directly emerge into the central convex portion. This portion can also be less convexly shaped than shown on the drawing. The invention is also applicable to other cans than those having a mantle with round cross section. Although not shown, the opening tab can furthermore be positioned within a downwardly bent portion of the elevation, whereby the opening obtained after the opening of the tab becomes positioned in a groove. Such a groove can also be created by forming the elevation laterally of the longitudinal edges of the tab with ridges.

I claim:

1. Can closure provided with opening tab and consisting of a plastic material or the like, including a peripheral fastening flange formed with a shank faced inwardly to the center of the closure and forming an outer side wall for a groove formed in the closure along the flange, the inner wall of the groove merging into a central portion, which relative to a plane through the upper edge of the flange is at least partly convexly shaped, characterized in that the groove along a smaller part of the peripheral flange is interrupted by a bent-up elevated portion, which is substantially flush with the upper edge of the flange and extends between said edge and the central portion, and that an opening tab extends from or near the flange along the elevated portion up to at least the transition to the central portion.

2. Can closure according to claim 1, characterized in that the opening tab extends up to near the center of the closure.

3. Can closure according to claim 1 or 2, characterized in that the opening tab has a widened inner end.

4. Can closure according to claim 1 or 2, characterized in means fastened to the outer portion of the opening tab for opening the tab.

5. Can closure according to claim 1 or 2, characterized in that at least the outer portion of the opening tab is positioned within a somewhat bentdown portion of the elevated portion.

6. Can closure according to claim 1 or 2, characterized in that the elevated portion is laterally of the longitudinal edges of the opening tab formed with ridges.

* * * * *